US010153606B2

(12) United States Patent
Cramer et al.

(10) Patent No.: US 10,153,606 B2
(45) Date of Patent: Dec. 11, 2018

(54) METHOD TO CONTROL CRIMPING PROCESSES USING ULTRASONIC TRANSMISSION ANALYSIS

(71) Applicant: The United States of America as represented by the Administrator of the National Aeronautics and Space Administration, Washington, DC (US)

(72) Inventors: Karl Elliott Cramer, Yorktown, VA (US); William T. Yost, Newport News, VA (US); Daniel F. Perey, Yorktown, VA (US)

(73) Assignee: THE UNITED STATES OF AMERICA AS REPRESENTED BY THE ADMINISTRATOR OF NASA, Washington, DC (US)

( * ) Notice: Subject to any disclaimer, the term of this patent is extended or adjusted under 35 U.S.C. 154(b) by 280 days.

(21) Appl. No.: 14/749,134

(22) Filed: Jun. 24, 2015

(65) Prior Publication Data

US 2016/0104994 A1 Apr. 14, 2016

Related U.S. Application Data

(60) Provisional application No. 62/062,187, filed on Oct. 10, 2014.

(51) Int. Cl.
*H01R 43/04* (2006.01)
*H01R 43/048* (2006.01)

(52) U.S. Cl.
CPC ..... *H01R 43/0486* (2013.01)

(58) Field of Classification Search
CPC ..... G01N 29/04; G01N 29/07; G01N 29/221; G01N 29/265; H01R 43/048; H01R 43/0486; H01R 43/0488; H01R 43/058; H01R 43/0207
See application file for complete search history.

(56) References Cited

U.S. PATENT DOCUMENTS 3,157,075 A 11/1964 Filia
3,292,413 A 12/1966 Falcioni
4,062,227 A 12/1977 Heyman
(Continued)

OTHER PUBLICATIONS

Cheng-Hsun et al., "Ultrasonic Evaluation of Temper-Embrittlement for Martensitic Stainless Steel," Materials Transactions, 2003, pp. 2363-2368, vol. 44, No. 11.
(Continued)

*Primary Examiner* — Paul D Kim
(74) *Attorney, Agent, or Firm* — Andrea Z. Warmbler; Robin W. Edwards; Mark P. Dvorscak

(57) ABSTRACT

A method of crimping wires includes positioning a wire/terminal combination between first and second crimp forming tools. A force is applied to the crimp forming tools to deform the wire/terminal combination. The method further includes measuring ultrasonic energy that is transmitted across the wire/terminal combination as the terminal is being deformed. A rate of change of the magnitude of the ultrasonic energy is also determined as the terminal is being deformed. The crimping process is terminated if the rate of change of the magnitude of the ultrasonic energy falls below a predefined threshold level. Data gathered during the crimping process can also be utilized to determine if a faulty crimp has occurred.

15 Claims, 6 Drawing Sheets

(56) References Cited

U.S. PATENT DOCUMENTS

| | | | | |
|---|---|---|---|---|
| 4,373,394 | A | 2/1983 | Renzel et al. | |
| 4,385,515 | A | 5/1983 | Link et al. | |
| 5,046,241 | A | 9/1991 | Ricard | |
| 5,092,026 | A | 3/1992 | Klemmer et al. | |
| 5,197,186 | A | 3/1993 | Strong et al. | |
| 5,297,435 | A | 3/1994 | Papazian | |
| 5,814,728 | A | 9/1998 | Okawa et al. | |
| 6,196,062 | B1 | 3/2001 | Wright et al. | |
| 6,393,924 | B1 | 5/2002 | Eder et al. | |
| 6,418,769 | B1 | 7/2002 | Schreiner | |
| 6,553,803 | B1 | 4/2003 | Heingartner et al. | |
| 7,181,942 | B2 | 2/2007 | Yost et al. | |
| 7,665,224 | B2 * | 2/2010 | Yagi | G01R 31/045 33/783 |
| 8,671,551 | B2 | 3/2014 | Yost et al. | |
| 9,362,700 | B2 * | 6/2016 | Charlton | H01R 43/0488 |
| 2004/0027578 | A1 | 2/2004 | Drake, Jr. | |
| 2004/0055354 | A1 | 3/2004 | Anton | |
| 2005/0193792 | A1 | 9/2005 | Yost et al. | |
| 2008/0276678 | A1 | 11/2008 | Pacaud et al. | |
| 2009/0314087 | A1 | 12/2009 | Ales et al. | |
| 2013/0145849 | A1 | 6/2013 | Yost et al. | |
| 2013/0197823 | A1 | 8/2013 | Williams | |

OTHER PUBLICATIONS

PCT International Search Report, PCT/US2012/023423, dated May 16, 2012.

* cited by examiner

METHOD TO CONTROL CRIMPING PROCESSES USING ULTRASONIC TRANSMISSION ANALYSIS

CROSS-REFERENCE TO RELATED PATENT APPLICATION

This patent application claims the benefit of and priority to U.S. Provisional Patent Application No. 62/062,187, titled "METHOD AND APPARATUS TO CONTROL THE AUTOMATED CRIMPING PROCESS USING ULTRASONIC TRANSMISSION ANALYSIS," filed on Oct. 10, 2014, the contents of which are hereby incorporated by reference in their entirety.

STATEMENT REGARDING FEDERALLY SPONSORED RESEARCH OR DEVELOPMENT

The invention described herein was made by employees of the United States Government and may be manufactured and used by or for the Government of the United States of America for governmental purposes without the payment of any royalties thereon or therefore.

FIELD OF THE INVENTION

This invention relates to forming crimped wire connections, and more specifically to a crimping process in which applied crimp force and ultrasonic energy are measured during the crimping process to control the crimping process and/or to indicate that the crimping process failed.

BACKGROUND OF THE INVENTION

Electro-mechanical crimp tools/machines may be used to form crimped connections on electrical wires. The electrical wires may include a plurality of individual strands that are inserted into a metal ferrule, and the ferrule is deformed (i.e. crimped) to compact the individual strands together and connect the electrical wire to the ferrule. Powered crimp tools/machines may include an electrically powered actuator that drives a pump that pressurizes hydraulic fluid: the pressurized hydraulic fluid is supplied to hydraulic cylinders that move the crimping dies relative to one another to crimp the ferrule tightly around the strands of the electrical wire. This type of powered crimping tool typically has a maximum crimping force that corresponds to a maximum hydraulic pressure. In known crimping processes, the full limit of hydraulic applied force is typically provided by electro-mechanical crimp tools during the crimping process. Once the maximum possible hydraulic pressure (i.e. applied force) is reached, the hydraulic pressure (i.e. force) is released to end the crimping process. In some known powered crimping tools/machines, the maximum hydraulic pressure (i.e. applied force) may be adjusted prior to initiating the crimping process. However, in this type of crimping tool/machine the present maximum hydraulic (i.e. applied force) is always reached during each crimp. Known powered crimping tools typically provide for changing the crimping dies for the appropriate terminal and wire gauge.

Known powered crimp tools/machines typically continue to apply force until a predefined level of force is reached. The maximum applied force is typically reached when the dies are fully closed such that no further movement of the dies is possible. Thus, known crimp tools typically continue to apply force until the dies contact one another and no further relative movement of the dies is possible. However, this may lead to excessive tool wear and reduced battery life (i.e. for battery powered tools). Furthermore, this type of operation does not provide the operator with feedback indicating the quality of the crimp, which can result in either under or over crimping. Prior methods include monitoring the crimping process by passing ultrasound signal at right angles to the terminal-wire axis of a hand-held, hand operated crimp tool and monitoring the total ultrasonic energy ("UT Energy") to determine the quality of the crimp. Other methods include monitoring the rate of change of the ultrasonic energy as a function of jaw position for an automated crimping machine to determine crimp quality.

Prior methods may permit collecting data during the crimping process. After the crimping process is completed, the data may be analyzed to determine the quality of the crimp that was formed. However, there is a need for an improved crimping process.

BRIEF SUMMARY OF THE INVENTION

One aspect of the present invention is a method of crimping wires. The method includes positioning at least one wire in a terminal to form a wire/terminal combination. The wire/terminal combination is positioned between at least first and second crimp forming tools such as first and second crimping dies. A force is applied to at least one of the first and second crimp forming tools to move the dies towards a closed position relative to one another and to deform the terminal. The method further includes measuring ultrasonic energy that is transmitted across the wire/terminal combination as the terminal is being deformed. The method also includes determining a rate of change of a magnitude of the ultrasonic energy transmitted across the wire/terminal combination as the terminal is being deformed. The method further includes terminating the crimping process by reducing the force being applied to the at least one crimp forming tool if the rate of change of the magnitude of the ultrasonic energy transmitted across the wire/terminal combination falls below a predefined threshold level.

Another aspect of the present invention is a method of determining if an acceptable crimp of a wire/terminal combination has been formed during a crimping process. The method includes measuring ultrasonic energy, applied force, and position of a crimp forming tool during a crimping process. The method further includes utilizing predefined criteria to determine if an acceptable crimp has occurred. The predefined criteria includes at least one of a measured ultrasonic energy peak occurring after a peak applied force has occurred, and a peak ultrasonic energy not reaching a predefined minimum value.

These and other features, advantages, and objects of the present invention will be further understood and appreciated by those skilled in the art by reference to the following specification, claims, and appended drawings.

DETAILED DESCRIPTION OF THE INVENTION

Figure 1:
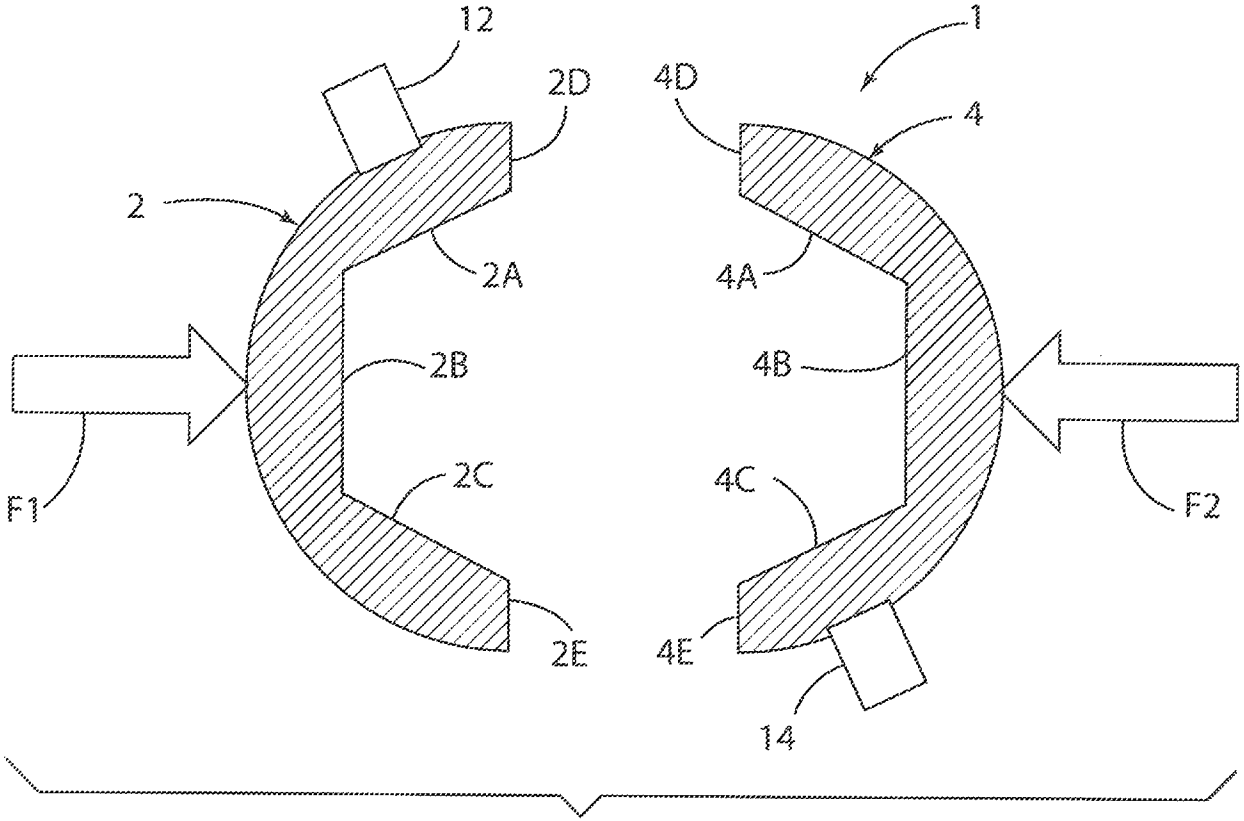
FIG. 1 is a schematic view showing first and second crimping dies in an open position prior to insertion of a wire/terminal combination for crimping.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to U.S. Pat. Nos. 8,671,551 and 7,181,942, the entire contents of which are hereby incorporated by reference.

One aspect of the present invention is a method of determining the appropriate force required to form a crimped electrical connection while using an electro-mechanical crimping tool/machine. Known electro-mechanical crimping tools/machines may comprise electrically powered stationary units or portable battery powered hand tools. Known electro-mechanical crimping tools/machines may utilize electrical power to provide hydraulic pressure that is utilized to generate an applied force on the crimping dies in the tool. This type of tool/machine is typically limited to a maximum applied force corresponding to a maximum allowable hydraulic pressure of the tool/machine. Electro-mechanical crimping tools/machines of this type are generally known in the art, such that a detailed description is not believed to be required.

The present invention involves measuring ultrasonic transmission (at right angles to the wire terminal axis, but off-axis to the applied force), crimp jaw position and hydraulic pressure (applied force) during the crimping process to allow the termination of the applied force/hydraulic pressure based on the rate of change of the ultrasonic energy, and to determine if a crimp has been fully formed. The present invention may be utilized in connection with hydraulically driven electro-mechanical (e.g. semi-automatic) crimping tools used in the termination of electrical wiring systems. However, it will be understood that the present invention is not limited to this type of crimping tool, and the invention may be utilized in connection with manual crimping tools and/or other types of powered crimping tools/machines.

According to one aspect of the present invention, crimp jaw position, hydraulic pressure (applied force) and ultrasonic energy are utilized to control the crimp process to ensure quality crimps are formed, enhance battery life, and reduce tool wear. Measuring position, applied force, and ultrasonic energy during the crimping process also provides an indication when faulty crimps are formed due to operator error, improper selection of terminal and/or die for a given wire gauge.

One aspect of the present invention is to monitor the ultrasonic signal (UT Energy) from an instrumented, electro-mechanical crimp tool/machine to determine the following: (1) The onset of crimping (from jaw position and ultrasonic signal) verses hydraulic pressure (i.e. applied force), which provides an indication of whether or not the correct crimp die/terminal combination has been used; and (2) the characteristics of the ultrasonic signal (UT Energy) as a function of hydraulic pressure (i.e. applied force), which may indicate both the completion of the crimping process and/or the quality of the crimp formed.

Figure 3:
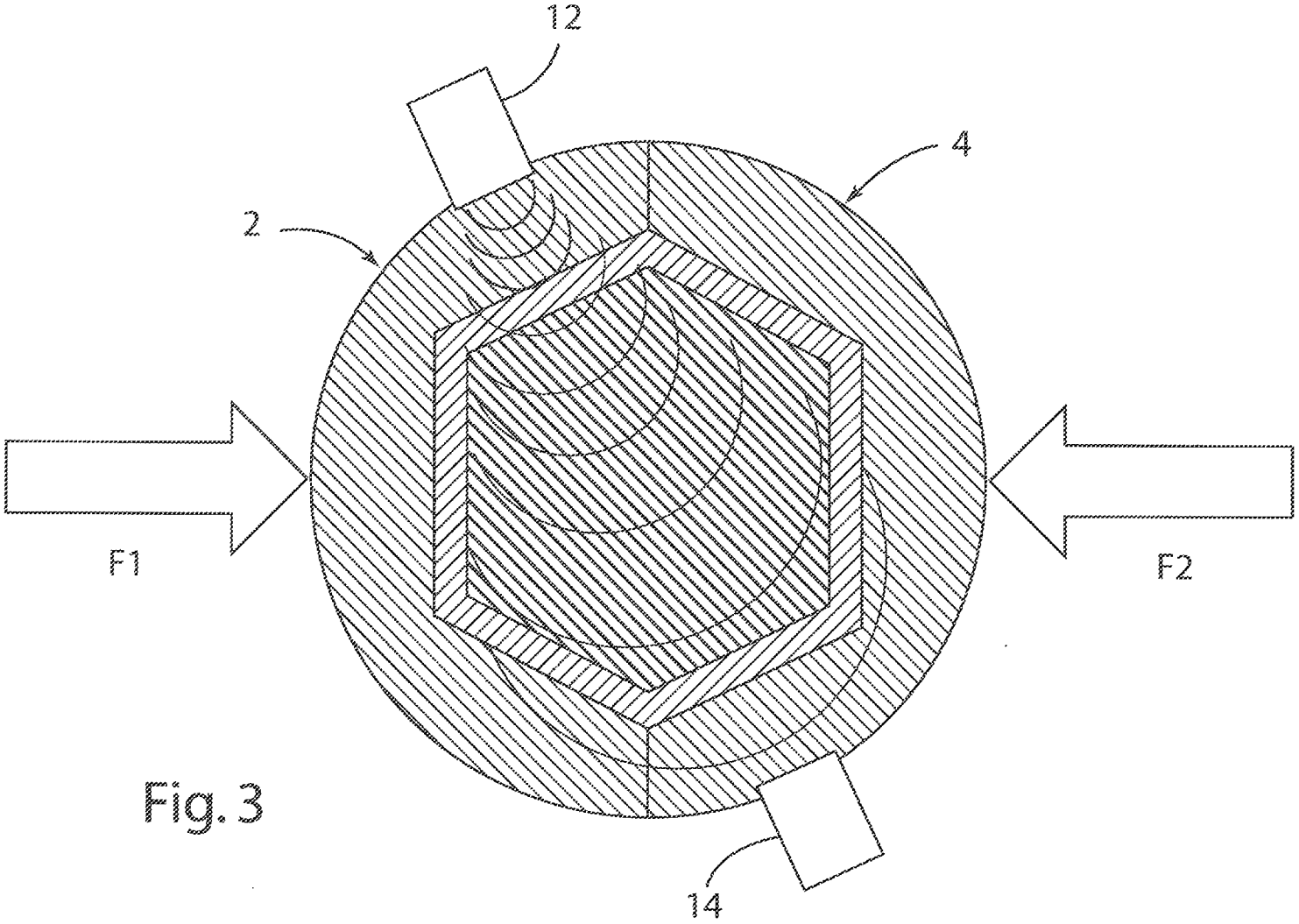
FIG. 3 is a schematic view showing a fully crimped connection in which the ferrule and wire strands have been fully compressed to form an acceptable crimped connection.

With reference to FIG. 1, a typical hexagonal crimping die 1 includes first and second dies 2 and 4, respectively, that may be used for large gauge wiring such as wire 8 and ferrule 10. Wire 8 and ferrule 10 together form a wire/terminal combination 15. Although hexagonal dies 2 and 4 with flat die surfaces 2A-2C and 4A-4C are shown, it will be understood that other die geometries may be used as well according to other aspects of the present invention. During the crimping process, the dies 2 and 4 are pushed together by applied mechanical forces (arrows "F1" and "F2") to provide the crimping force needed to form the final crimped connection. One of the dies 2 or 4 may be mounted to a primary tool/machine structure (not shown), and the other die may be mounted to a movable tool jaw/component that is operably connected to a powered actuator such as a hydraulic cylinder (not shown) that moves the jaw/component. Thus, in this case, force F1 is equal to F2, and forces F1 and F2 comprise "applied forces" as this term is used herein. As discussed in more detail below, dies 2 and 4 may include surfaces 2D, 2E, 4D, and 4E, respectively, that contact one another when the dies 2 and 4 are in the fully closed position (FIG. 3). Before the dies 2 and 4 reach the fully closed position of FIG. 3, surface 2D is spaced apart from surface 4D, surface 2E is spaced apart from surface 4E, and one or more of the surfaces 2A-2C of die 2 and surfaces 4A-4C of die 4 contact outer surface 11 of a ferrule 10 of wire/terminal combination 15. The dies 2 and 4 apply a crimping force on the ferrule 10 when the dies 2 and 4 are not fully closed that is equal to the applied forces F1 and F2. However, when the dies 2 and 4 are in the fully closed position (FIG. 3), the surface 2D of die 2 contacts the surface 4D of die 4, and the surface 2E contacts the surface 4E. Thus, when the dies 2 and 4 are in the fully closed position of FIG. 3, the applied forces F1 and F2 are equal to the sum of the crimping force acting on the ferrule 10 and the forces resulting from contact between dies 2 and 4.

Referring again to FIG. 1, transmit and receive ultrasonic transducers 12 and 14, respectively, are preferably arranged in a "through transmission" configuration, but off axis of the applied force F1, F2. Typical transducer frequencies for this application are from about 5 MHz to about 20 MHz. The transducer frequency is chosen on the basis of optimal ultrasonic energy transmission required as well as the resolution needed for a particular geometry and application. For ease of illustration, transducers 12 and 14 are shown affixed to the dies 2 and 4, respectively. Alternatively, the transducers 12 and/or 14 could be attached to the tooling (not shown) that holds dies 2 and 4 in place and provides the support for the dies 2 and 4 during the crimping process. Ultrasonic transducers 12 and 14 may be operably connected to a controller and/or a computer (not shown) and/or other electrical components to provide active control of the crimping process and to provide for processing and storage of data collected during the crimping process.

Figure 2:
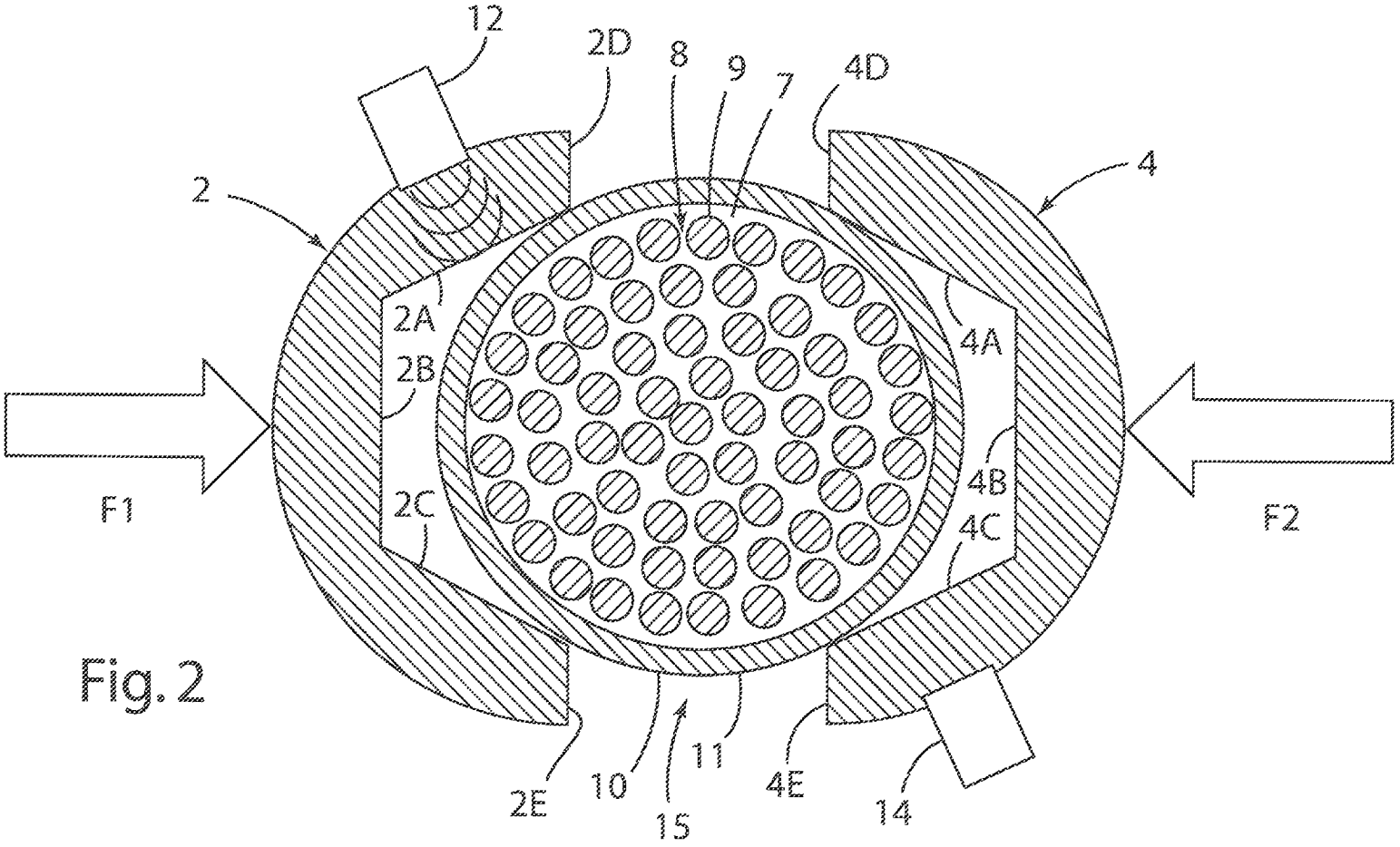
FIG. 2 is a schematic view showing a wire/terminal combination positioned between a pair of dies as the crimping process is initiated.

A crimping process according to one aspect of the present invention is shown FIGS. 2 and 3. First, a wire 8 including a plurality of individual strands 9 is inserted into a ferrule 10 to form an uncrimped wire/terminal combination 15. The individual strands 9 are initially not tightly compacted together whereby space 7 is formed between strands 9. Strands 9 of wire 8 and ferrule 10 preferably comprise copper and/or other electrically conductive material that is at least somewhat ductile whereby the strands 9 and/or ferrule 10 can be permanently (plastically) deformed during the crimping process. The uncrimped wire/terminal combination 15 is loaded into the crimping tool/machine and positioned between forming tools such as dies 2 and 4. The dies 2 and 4 are shifted until they begin to make contact with outer surface 11 of the ferrule 10 (FIG. 2). The mechanical force provided by the hydraulics (applied force F1, F2) continues to increase until a fully crimped connection 16 is completely formed as shown in FIG. 3. When the crimp 16 is fully formed, the individual strands 9 are tightly compacted together and/or deformed to form a center portion 13 of crimped connection 16 that is substantially solid. In FIG. 3, the center portion 13 is shown as a solid, unitary mass with no gaps or boundaries between the individual wire strands 9. However, it will be understood that some relatively small gaps between some portions of adjacent strands 9 may be present. Also, the individual strands 9 do not necessarily fuse to adjacent strands, and the center portion 13 does not necessarily comprise a single unitary metal structure.

Figure 4:
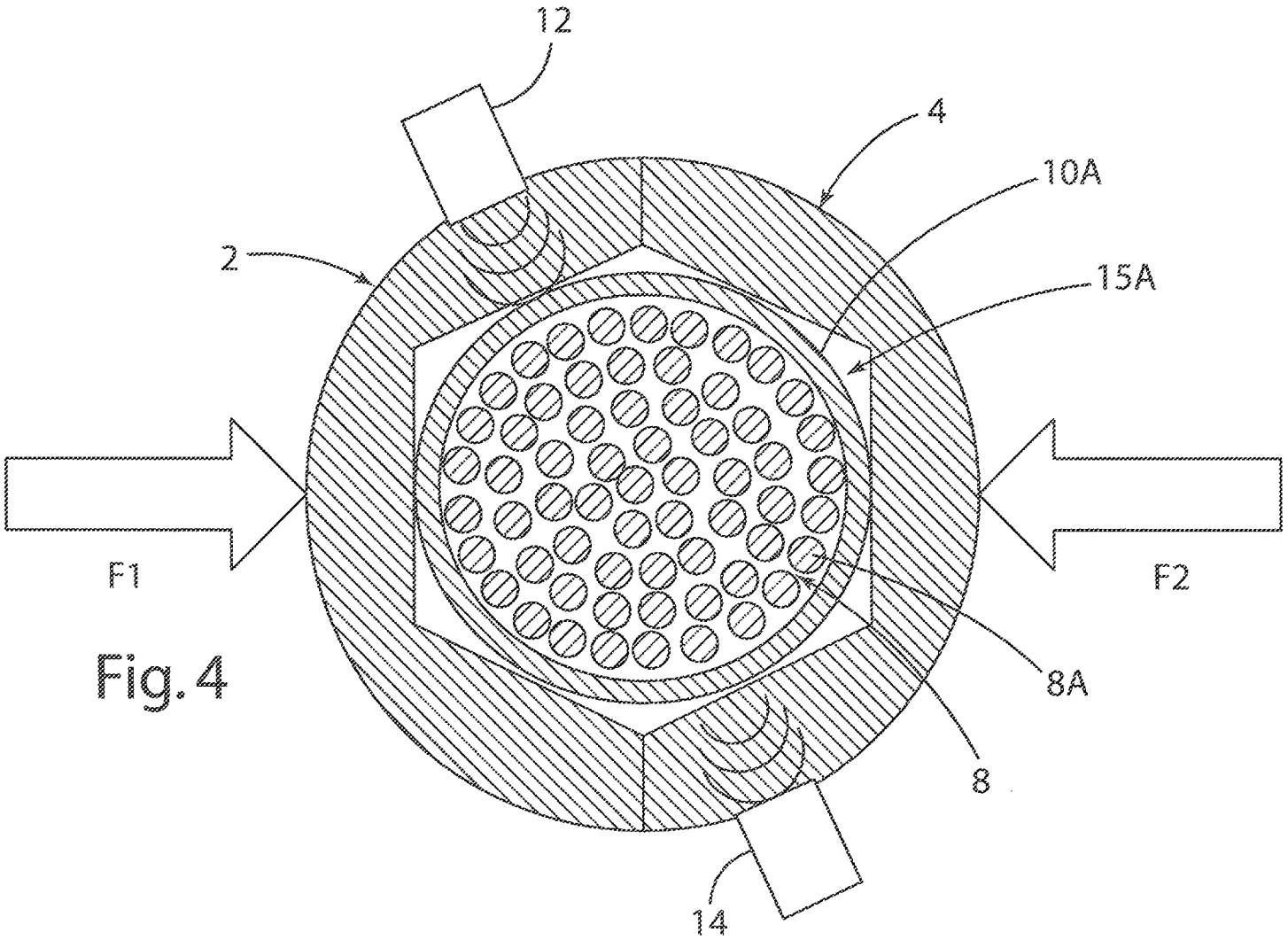
FIG. 4 is a schematic view showing an improper crimp operation in which the crimping dies have reached the fully closed position without fully crimping the wire/terminal combination.

During the crimping process ultrasonic data is recorded at a set rate (typically 1 ultrasonic pulse every 2 ms). Initially, no ultrasonic signal is present in the receive transducer 14 because no path for the ultrasound is possible while the dies 2 and 4 are out of alignment (i.e. spaced apart) due to the spaces 7 (FIG. 2) between strands 9. If the hydraulic pressure (applied force F1, F2) increases rapidly during the crimping process but the ultrasonic signal (UT Energy) stays relatively small, this is an indication that the die set 2, 4 is too large for the terminal/wire combination 15, and the surfaces 2D, 2E have come into contact with surfaces 4D, 4E, respectively, without fully compressing ferrule 10 to reduce/eliminate spaces 7 between strands 9 (FIG. 4).

Alternatively, if the die set (dies 2 and 4) is too small, the hydraulic force (applied force F1, F2) will increase rapidly, but the dies 2 and 4 will never fully compress/contact one another, and the dies 2 and 4 do not reach the positions shown in FIG. 3 (a case in which dies 2, 4 are too small is not shown in FIGS. 1-4). Thus, if the dies 2 and 4 are too small, the transducers 12 and 14 will not move into alignment and very little ultrasonic signal (UT Energy) will be recorded by the receive transducer 14. Either of these two conditions indicate that the crimp had not been successfully executed. The force and position data, as well as the UT Energy data may be provided to an operator of the crimping tool/machine whereby the operator is able to determine if a crimp operation was faulty. As discussed in more detail below, the data may also be processed by a computer/controller and an indicator/warning may be provided to the operator if a faulty crimp has occurred.

Referring again to FIG. 3, if the correct dies 2 and 4 and the correct wire and terminal combination 15 is used, the ultrasonic signal (UT Energy) at the receive transducer 14 will increase until the crimp 16 is fully formed, at which time the ultrasonic signal will stop increasing. In FIG. 3, the strands 9 are tightly compacted together and/or deformed, and the center portion 13 therefore transmits UT Energy in substantially the same manner as a solid metal component having the same size, shape, and material composition. As discussed below, a number of signal processing techniques (such as determining the zero crossing of the second derivative) can be used to determine when the ultrasonic signal (UT Energy) stops increasing, and the application of forces F1 and F2 can be terminated to stop/complete the crimping process.

Figure 5:
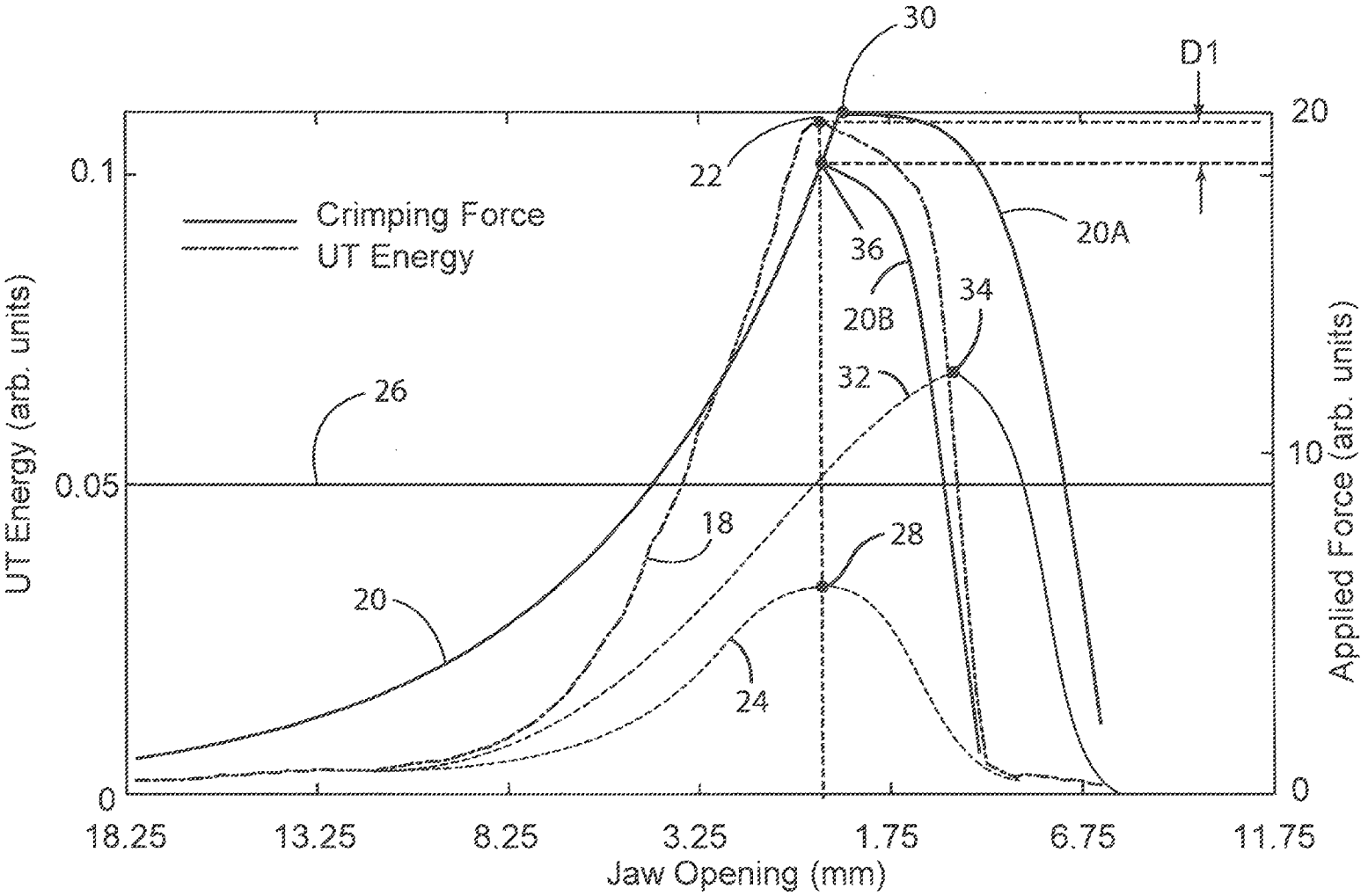
FIG. 5 is a graph showing UT Energy and applied crimping force as a function of die position (Jaw Opening)

FIG. 5 shows typical ultrasonic energy data (line 18) acquired during the process of crimp formation and also shows typical applied force (line 20) utilized in the crimping process. The applied force curve/line 18 in FIG. 5 corresponds to the applied force F1, F2 of FIGS. 1-4. It will be understood that other applied force curves are possible according to the present invention. Nevertheless, the fundamental technique (terminating the crimping process by reducing/terminating the applied force when the UT Energy stops increasing) may be the same for various force curves. When the ultrasonic energy stops increasing (i.e. the slope of line 18 in FIG. 5 becomes zero) at point 22 the crimp 16 is fully formed and no further applied force is required.

Figure 6:
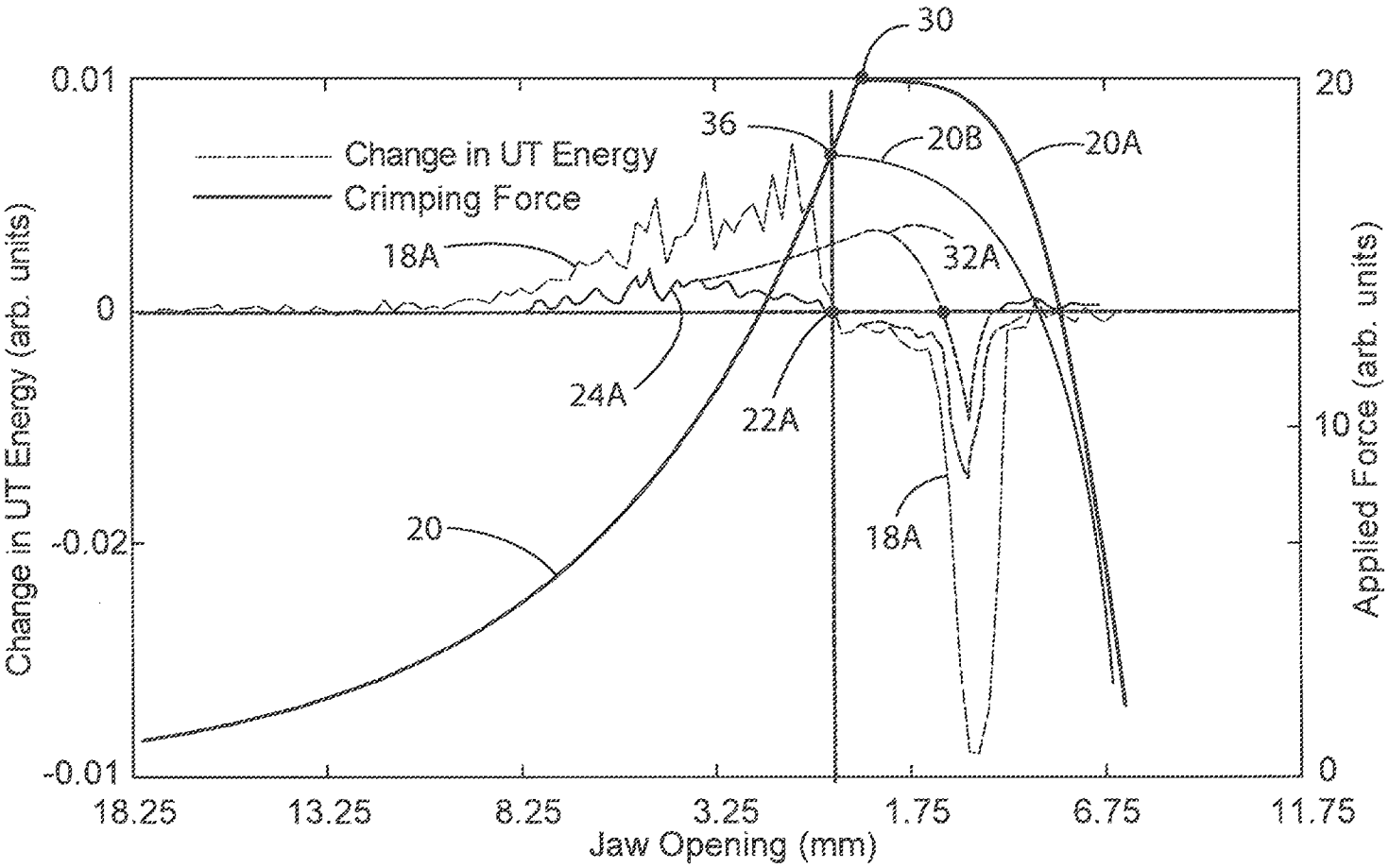
FIG. 6 is a graph showing the change in UT Energy and the applied crimping force as a function of die position (Jaw Opening).

With further reference to FIG. 6, the point of full crimp formation can be determined by differentiating the ultrasonic energy curve 18 (a signal processing technique) of FIG. 5 with respect to the die position/location ("Jaw Opening" in FIGS. 5 and 6). Line 18A in FIG. 6 shows the change in UT Energy as a function of die position ("Jaw Opening"). Thus, line 18A of FIG. 6 is the derivative of line 18 of FIG. 5. The magnitude of the change in UT Energy drops to zero at point 22A. Zero crossing point 22A of FIG. 6 corresponds to the point 22 in FIG. 5 at which the slope of line 18 is zero and transitions from positive to negative. Various known signal processing techniques may be utilized to determine when during the crimping process the UT Energy stops increasing. These could be time based techniques or frequency based techniques.

The zero crossing point 22A may be used to terminate the crimping process (stop applying force), provided the zero crossing is not achieved before the mechanical limits of force are reached. Force peak 30 of applied force line 20 in FIG. 5 corresponds to a maximum possible force that can be generated by the crimping tool/machine. In prior known processes, force is applied until the peak force 30 is reached, even though the crimp 16 is fully formed before this at the UT Energy peak 22. According to one aspect of the present invention, the applied force is reduced/terminated at point 36 of applied force line 20, and the applied force is then reduced as shown by the decreasing applied force line segment 20B. The maximum applied force is therefore reduced by the distance "D1" between points 30 and 36. As discussed below, the work/energy required for the crimping operation is also significantly reduced as shown by the reduction in area between the applied force lines 20A and 20B.

With reference to FIG. 4, if a ferrule 10A that is too small for dies 2 and 4 is utilized to crimp a wire 8A, the dies 2 and 4 will reach the fully closed position without fully crimping the wire/terminal combination 15A. Because the individual strands 9A of wire 8 are not closely compacted together even when dies 2 and 4 are closed, a relatively low amount of UT Energy is received by transducer 14 even though a relatively large force F1, F2 has been applied. With further reference to FIG. 5, improper die sizing as shown in FIG. 4 may lead to relatively low UT Energy as shown by the UT Energy line 24 coupled with a relatively large amount of applied force as shown by the line 20. If the peak UT Energy (e.g. point 28)

is below a predefined threshold criteria (e.g. line 26), an indicator or warning can be generated to alert the operator that an improper crimp has occurred. In the illustrated example, the predefined UT Energy threshold criteria is 0.05. However, the predefined minimum required UT Energy may be selected based on experimental data and testing to determine an appropriate UT Energy threshold criteria as may be required for a particular application.

Referring again to FIG. 6, if dies 2 and 4 are too large (e.g. FIG. 4), the change in UT Energy may be reduced as shown by the UT Energy line 24A of FIG. 6. The crimping process may be stopped when the change in UT Energy 24A crosses the 0 horizontal axes (e.g. point 22A). Although the process may be controlled based on the change in UT Energy being zero, in this situation the resulting crimp will nevertheless be faulty due to the incorrect dies 2 and 4 (e.g. FIG. 4).

Referring again to FIG. 5, if dies 2 and 4 are too small for the wire/terminal combination 15 being crimped, the UT Energy may continue to increase after the peak 30 of the applied force is reached as shown by the UT Energy line 32. If the dies 2 and 4 are too small, the UT Energy may peak at a point 34 after the peak force point 30. In contrast, as discussed above, if the dies 2 and 4 are properly sized (FIG. 3), the peak 22 of the UT Energy will occur prior to the peak 30 of the applied force (if the crimping process is continued until the maximum possible force is applied). The crimping process may be terminated by terminating/reducing the applied force if the UT Energy stops increasing or if the maximum possible crimping force 30 (FIG. 5) has been reached. If the peak 34 of the UT Energy occurs after the peak 30 of the applied force, an alert or warning may be generated indicating that an improper crimp operation has occurred. The alert or warning may comprise an audio signal, blinking light, or the like. The alert may also comprise a notification or other indicator that is embedded in data recorded during the crimping process.

Thus, the change in UT Energy as a function of die position ("Jaw Opening"), can be used to actively control the crimping process/tool such that no additional force is applied at the point 36 (FIGS. 5 and 6). As a result of the active control, the force is reduced as shown by the line 20B rather than following the line 20A of conventional crimping processes. As discussed above, in conventional crimping processes the applied force is removed once a predefined peak force is reached at the point 30 regardless of what the UT Energy levels may be during the crimping process. As shown in FIGS. 5 and 6, the point 36 at which active control according to the present invention shuts off or terminates the application of force is significantly lower (distance "D1") than the point 30 of conventional crimping processes. Thus, the peak force may be significantly reduced, thereby reducing the wear on the dies and other components. Also, the work (energy) performed by the tool/machine during the crimping process is generally equal to the area under the force curves 20, 20A, and 20B of FIG. 6. Because the total applied force is reduced, the area under the curve 20B is significantly less than the area under the curve 20A. Accordingly, the amount of energy required to perform a crimp operation may be significantly reduced in accordance with the present invention. The present invention may be utilized in connection with portable battery powered crimping tools. The reduction in energy required to perform a crimping operation may therefore significantly increase the battery life of the tool, reducing the need to change and/or recharge the batteries.

The technology/process of the present invention may also be utilized in manual (hand) operated crimping tools by utilizing sensors or other means of measuring both the die closure (die position) and the applied force. Once sufficient force to form the crimp has been provided by the operator, feedback such as an audio signal and/or indicator light may be provided to the operator, and the operator may then terminate the crimping process by releasing the manual force applied to the hand tool.

According to another aspect of the present invention, multiple transducers may be applied to dies with more complex geometries. For example, one transmit transducer and multiple receive transducers or multiple transmit/receive transducer pairs could be utilized.

Unique features of the invention include combining ultrasonic data with both die position and instantaneous applied force to regulate the force applied during the crimping process in order to maximize battery life (for a battery operated tool), minimize die/tool wear, and ensure crimp quality. The additional information allows for better quality crimp, longer battery life and longer tool life, and may also provide immediate feedback to the operator if an improper crimp operation has occurred.

FIGS. 5 and 6 show typical UT Energy and force data for an electro-mechanical portable/hand operated (powered) crimping tools. However, it will be understood that stationary crimping tools/machines typically have somewhat similar UT Energy and force curves, and the present invention is not limited to any particular type of crimping tool/machine.

Also, the processes/methods of the present application may be utilized with various types of crimping tools/crimping dies as may be required for a particular application. Examples of other crimp forming tools or dies include the anvil and jaw of U.S. Pat. No. 8,671,551, and the punch and anvil of U.S. Pat. No. 7,181,942. Although the shape of the force and UT Energy curves (e.g. FIGS. 5 and 6) may vary depending upon the type of forming tools/dies utilized and the design of the particular crimp components, the processes/methods described above may be utilized to control the crimping operation and/or to determine if a faulty crimp operation has occurred in various types of crimping operations. Specifically, regardless of what type of forming tool is utilized in the crimping process, the force applied during the crimping process may be terminated when the UT Energy stops increasing, and a warning or other indicator may be generated if the UT Energy peak falls below a predefined minimum required level and/or if the UT Energy stops increasing after the peak applied force has been applied.

It will be understood that the crimping process would not necessarily have to be terminated at the precise point at which the UT Energy changes from positive to negative shown by the points 22 (FIG. 5) and 22A (FIG. 6). For example, termination of the crimping process could be delayed slightly following the zero crossing point 22A (FIG. 6). This could be utilized to account for variations/fluctuations in the change in UT Energy. For example, if the Change in UT Energy line 18A for a particular case is relatively flat in the region of the zero crossing point 22A, line 18A may momentarily cross the zero line and drop below the zero line by a small amount, followed by movement above the zero line, followed by a drop below the zero line. Various numerical techniques such as curve fitting and the like may be utilized to smooth the change in UT line 18A, and the criteria for terminating the crimping process could be based on a curve fit line rather than the actual change in UT Energy line 18A. Furthermore, the criteria may include other factors such as, for example, a curve fit line for change in UT Energy line 18A having a zero or negative value for at least a predetermined change in jaw position ("Jaw Opening"). For example, the criteria could comprise the change in UT Energy line 18A being zero or negative for at least 0.1 mm of Jaw Opening/position, or the criteria could comprise a curve fit of change in UT Energy line 18A being zero or negative for at least 0.1 mm of Jaw Opening. Also, it will be understood that terminating the crimping process would not necessarily require an instantaneous/complete removal of the applied forces F1 and F2. For example, the magnitude of the applied force could be increased very slowly or held constant momentarily when the change in UT Energy line 18A (FIG. 6) reaches zero to terminate the crimping process. Thus, the crimping process may be terminated in various ways according to the present invention, and the present invention is not limited to a specific reduction in force occurring at or after the peak in UT Energy transmission to terminate the crimping process.

Also, in FIGS. 5 and 6 the relative position of the crimp forming tools (Jaw Opening) is shown on the horizontal axis. If the jaws move at a constant rate, the Jaw Opening of FIGS. 5 and 6 corresponds to time during the crimping process. For example, at the start of the crimping process (i.e. t=0.0), the jaw opening is 18.25 mm. If the jaws move at 5 mm per second, the Jaw Opening designated 13.25 mm will correspond to t=1.0 seconds. If the jaws or forming tools (e.g. dies 2 and 4) do not move at a constant rate relative to one another, the Jaw Opening positions in FIGS. 5 and 6 will not have a one-to-one correspondence to the elapsed time from the start of the crimping process. Nevertheless, even if the movement of the dies 2 and 4 is not a constant velocity, the time will increase as the Jaw Opening moves from left to right in FIGS. 5 and 6.

Thus, the force and UT Energy lines in FIGS. 5 and 6 generally show changes in UT Energy and applied force with time. For example, the peak 34 in UT Energy (FIG. 5) occurs after the peak force 30 in FIG. 5. This will be the case even if the jaws do not move at a constant velocity. It will be understood that terms such as "before," "after," "prior to," "followed by" as used herein generally refer to a temporal sequence of events which may not have a one-to-one correspondence to the relative position (Jaw Opening) of the forming tools as shown in FIGS. 5 and 6.

The invention claimed is:

1. A method of crimping wires, the method comprising:
positioning at least one wire in a terminal to form a wire/terminal combination;
positioning the wire/terminal combination between at least first and second crimp forming tools;
applying a force to at least one of the first and second crimp forming tools to move the crimp forming tools towards a closed position relative to one another and thereby deform the terminal;
measuring ultrasonic energy transmitted across the wire/terminal combination as the terminal is being deformed;
determining a rate of change of a magnitude of the ultrasonic energy transmitted across the wire/terminal combination as the terminal is being deformed; and
terminating the crimping process by reducing the force being applied to at least one of the first or second crimp forming tools when the rate of change of the magnitude of the ultrasonic energy transmitted across the wire/terminal combination falls below a predefined threshold level, and wherein the predefined threshold level is zero.

2. The method of claim 1, wherein:
the crimping process is terminated if a maximum measured ultrasonic energy does not reach a predefined threshold even if the rate of change of the magnitude of the ultrasonic energy does not fall below the predefined threshold.

3. The method of claim 1, wherein:
the crimping process is terminated if a predefined maximum crimping force is applied even if the rate of change of the magnitude of the ultrasonic energy does not fall below the predefined threshold.

4. The method of claim 3, further comprising:
providing an indicator that the crimping process was not successful if the predefined maximum crimping force is applied.

5. The method of claim 1, wherein:
the applied force is reduced in response to the rate of change of the magnitude of the ultrasonic energy transmitted across the wire/terminal changing from a positive value to a negative value.

6. The method of claim 1, further comprising:
providing an indicator that the crimping process was not successful if a maximum measured ultrasonic energy does not reach a predefined threshold.

7. The method of claim 1, wherein:
the crimping force is increased until after the rate of change of the magnitude of the ultrasonic energy transmitted across the wire/terminal changes from a positive value to a negative value.

8. The method of claim 1, wherein:
the first and second crimp forming tools comprise first and second crimping dies, respectively; and wherein:
at least one powered actuator is utilized to apply force to the first and second crimping dies.

9. The method of claim 8, wherein:
the at least one powered actuator comprises a hydraulic actuator that applies an increasing force as a distance between the first and second crimping dies decreases.

10. The method of claim 1, further comprising:
measuring a position of the first and second crimp forming tools relative to each other, and wherein:
the rate of change of a magnitude of the ultrasonic energy transmitted across the wire/terminal combination comprises a derivative of the magnitude of the ultrasonic energy with respect to the position of the first and second crimp forming tools relative to each other.

11. The method of claim 10, further comprising:
comparing an increase in the crimping force that occurs while the terminal is being deformed to a predefined acceptable increase in crimping force to determine if an unacceptable crimp has occurred.

12. The method of claim 1, wherein:
the ultrasonic energy is measured utilizing at least one transmit transducer mounted to the first crimp forming tool and at least one receive transducer mounted to the second crimp forming tool.

13. The method of claim 1, wherein:
the first and second crimp forming tools comprise an anvil and a punch or jaw, respectively.

14. The method of claim 1, wherein:
the first and second crimp forming tools each includes at least two planar forming surfaces disposed at an obtuse angle relative to each other.

15. The method of claim 1, including:
utilizing a sensor to measure the crimping force; and wherein:
the first and second crimp forming tools are mounted in a crimping tool that is configured to be actuated by hand.

* * * * *